US007909184B2

(12) United States Patent
Clark et al.

(10) Patent No.: US 7,909,184 B2
(45) Date of Patent: Mar. 22, 2011

(54) CAPSULE MERCHANDISING CAGE

(75) Inventors: Jeremy A. Clark, Minneapolis, MN (US); Michael A. Whittier, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 621 days.

(21) Appl. No.: 11/876,532

(22) Filed: Oct. 22, 2007

(65) Prior Publication Data

US 2009/0101610 A1 Apr. 23, 2009

(51) Int. Cl.
*A47F 5/08* (2006.01)

(52) U.S. Cl. ..... 211/87.01; 211/85.3; 211/189

(58) Field of Classification Search ..... 211/181.1, 211/41.1–41.9, 85.3, 86.01, 87.01, 88.01, 211/94.01, 189, 183, 187, 290, 207; 248/304–305, 248/339–340, 690, 692; 312/245–246, 350
See application file for complete search history.

(56) References Cited

U.S. PATENT DOCUMENTS

| | | | | | |
|---|---|---|---|---|---|
| 56,569 | A | * | 7/1866 | Keener | 211/32 |
| 815,480 | A | * | 3/1906 | Silven | 248/455 |
| D125,639 | S | | 3/1941 | Larson | |
| D182,404 | S | * | 4/1958 | Dickson | D6/462 |
| 2,891,678 | A | | 6/1959 | Levy | |
| D186,254 | S | | 9/1959 | Tirlet | |
| 3,003,644 | A | * | 10/1961 | Hildebrand | 211/74 |
| 3,174,714 | A | | 3/1965 | Bradsby | |
| 3,198,469 | A | * | 8/1965 | Callanan | 248/220.22 |
| 3,200,960 | A | * | 8/1965 | Banse | 206/459.5 |
| 3,490,598 | A | | 1/1970 | Federman | |
| 3,698,565 | A | * | 10/1972 | Weber | 211/87.01 |
| 3,997,060 | A | | 12/1976 | Kunin | |
| 4,040,522 | A | * | 8/1977 | Vickery | 211/88.01 |
| 4,109,797 | A | | 8/1978 | Brunette | |
| 4,234,094 | A | * | 11/1980 | Jorgensen | 211/88.01 |
| D278,773 | S | * | 5/1985 | Licari et al. | D6/462 |
| 4,688,683 | A | * | 8/1987 | Thalenfeld et al. | 211/57.1 |
| 4,919,280 | A | | 4/1990 | Phillips | |
| 4,944,415 | A | * | 7/1990 | Orbach | 211/75 |
| D323,600 | S | * | 2/1992 | Patke | D7/704 |
| 5,215,199 | A | * | 6/1993 | Bejarano | 211/74 |
| 5,299,698 | A | | 4/1994 | Gay | |
| 5,482,168 | A | * | 1/1996 | Welch et al. | 211/106 |
| 5,573,124 | A | | 11/1996 | Frost | |
| 5,697,507 | A | * | 12/1997 | Blass | 211/94.01 |
| 5,769,248 | A | | 6/1998 | Johnson | |
| 5,788,092 | A | * | 8/1998 | Teeney | 211/70.6 |
| 5,788,093 | A | | 8/1998 | Krut | |
| 5,857,578 | A | * | 1/1999 | Fishman | 211/189 |
| 5,947,307 | A | | 9/1999 | Battaglia et al. | |
| D427,831 | S | * | 7/2000 | Corley | D6/566 |
| 6,089,387 | A | | 7/2000 | Varfolomeeva | |
| D429,938 | S | * | 8/2000 | Allen | D6/566 |
| D432,332 | S | | 10/2000 | Kashima | |
| D446,369 | S | * | 8/2001 | Smith et al. | D32/55 |

(Continued)

*Primary Examiner* — Darnell M Jayne
*Assistant Examiner* — Devin Barnett
(74) *Attorney, Agent, or Firm* — Nixon & Vanderhye P.C.

(57) ABSTRACT

A merchandising system for displaying products in a retail environment includes a panel structure extending upwardly from a floor, the panel structure forming a plurality of regularly, or uniformly, spaced insertion areas. The system also includes an annular cage supported over the floor by the panel structure such that it projects outwardly from the front of the panel structure. The annular cage optionally includes a first loop defining a front and a back with the back facing toward the panel structure and the front facing away from the panel structure.

15 Claims, 7 Drawing Sheets

U.S. PATENT DOCUMENTS

| | | | | |
|---|---|---|---|---|
| D449,481 | S * | 10/2001 | Snell | D6/566 |
| 6,299,001 | B1 | 10/2001 | Frolov et al. | |
| 6,330,950 | B1 * | 12/2001 | Loika | 211/85.7 |
| 6,349,909 | B1 * | 2/2002 | Zarrow et al. | 248/220.41 |
| 6,564,952 | B1 * | 5/2003 | Suttles | 211/187 |
| 6,601,808 | B1 * | 8/2003 | Nagel | 248/220.31 |
| D497,750 | S * | 11/2004 | Ruffell | D6/515 |
| 6,883,671 | B2 | 4/2005 | Rushing | |
| D524,573 | S | 7/2006 | Robinson et al. | |
| 7,137,516 | B2 * | 11/2006 | Perry | 211/106 |
| 7,228,977 | B2 * | 6/2007 | Perkins et al. | 211/94.01 |
| 7,278,622 | B2 * | 10/2007 | Cooper | 248/457 |
| 7,338,021 | B2 * | 3/2008 | Barkdoll et al. | 248/220.31 |
| 7,392,912 | B2 * | 7/2008 | Zandt | 211/94.01 |
| 7,428,972 | B2 * | 9/2008 | Warner et al. | 211/59.1 |
| 7,641,056 | B2 * | 1/2010 | Schulman | 211/11 |
| 7,708,153 | B2 * | 5/2010 | Mansfield et al. | 211/7 |
| 2003/0094427 | A1 * | 5/2003 | Suttles | 211/187 |
| 2003/0189019 | A1 * | 10/2003 | Campbell et al. | 211/94.01 |
| 2005/0127016 | A1 * | 6/2005 | Fischer | 211/94.01 |
| 2006/0102567 | A1 * | 5/2006 | Stukenberg | 211/41.1 |
| 2007/0039907 | A1 * | 2/2007 | Zandt | 211/57.1 |
| 2008/0257841 | A1 * | 10/2008 | Abernathy | 211/87.01 |
| 2010/0096347 | A1 * | 4/2010 | Theobald et al. | 211/85.7 |

* cited by examiner

CAPSULE MERCHANDISING CAGE

BACKGROUND

Fixtures are often used to support and display merchandise in a retail environment. Fixtures that are accessible, space efficient, and visually effective help promote retail sales and overall merchandising efficacy. While traditional fixtures accomplish these goals to some extent, enhancements in the functionality, or overall merchandising effect, of display fixtures remain to be realized.

SUMMARY

Some aspects of the invention relate to a merchandising system for displaying products in a retail environment. In some embodiments, the system includes a panel structure extending upwardly from a floor, the panel structure forming a plurality of regularly, or uniformly, spaced insertion areas. The system also includes an annular cage supported over the floor by the panel structure such that it projects outwardly from the front of the panel structure. The annular cage optionally includes a first loop defining a front and a back with the back facing toward the panel structure and the front facing away from the panel structure.

The first loop has four substantially flat sides interconnected at rounded corners such that the first loop has a semi-oval shape. The cage also includes a second loop defining a front and a back where the second loop is oriented parallel to the first loop and positioned laterally adjacent the first loop. The second loop also has four substantially flat sides interconnected at rounded corners such that the first loop has a semi-oval shape. The cage further includes at least two front tie members spaced vertically adjacent from one another that extend laterally between the fronts of the first and second loops and at least two back tie members spaced vertically adjacent from one another and extending laterally between the backs of the first and second loops.

In some embodiments, a first stirrup is releasably secured to one of the back tie members and a first one of the insertion areas of the panel structure. A second stirrup is optionally spaced laterally from the first stirrup and is releasably secured to one of the back tie members and one of the insertion areas of the panel structure at a laterally spaced position from the first stirrup. Aspects of the invention address various, other accessories usable with the system as well as methods of using the system to display, store, merchandise, or present, for example, various types of items.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 2:
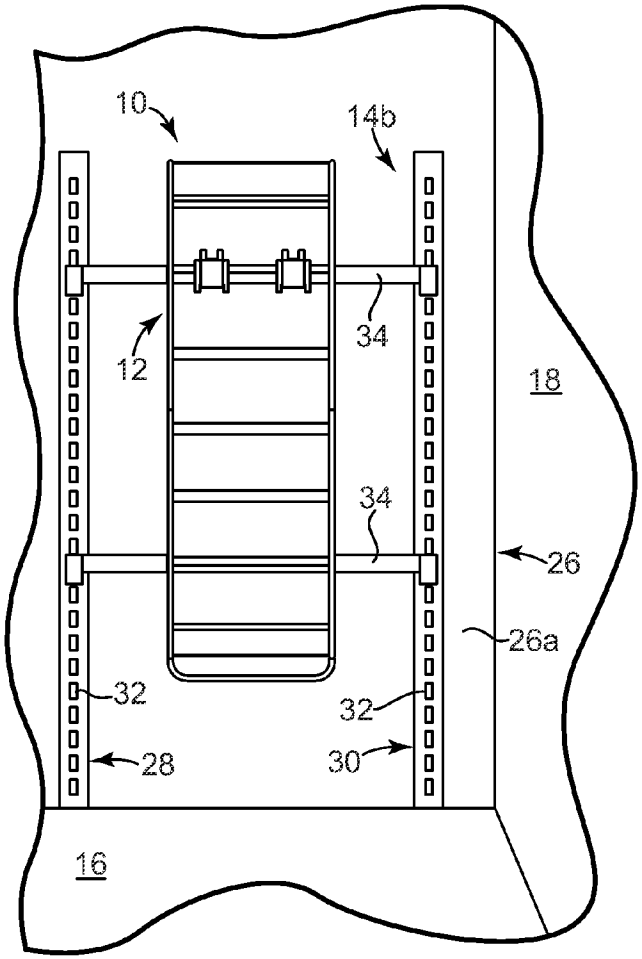
FIG. 2 shows a merchandising system including a second support assembly configuration, according to some embodiments of the invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Figure 1:
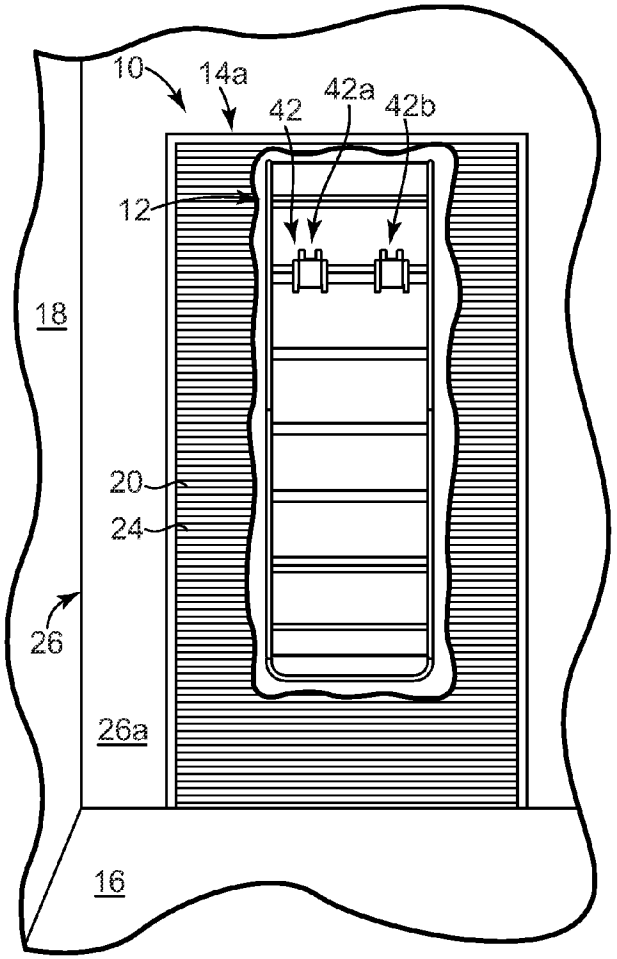
FIG. 1 shows a merchandising system including a first support assembly configuration, according to some embodiments of the invention.

FIG. 1 shows a merchandising system 10 according to some embodiments of the present invention. The system 10 includes a merchandising cage 12 releasably secured to a support assembly 14*a* that extends substantially vertically relative to a floor 16 in a retail environment 18. The support assembly 14*a* of FIG. 1 includes a plurality of substantially horizontal rods 20, or bars, that are regularly, or uniformly, spaced from one another to define a plurality of slots 24, also described as insertion areas or openings. The slots 24 are defined by, and interleaved between the rods 20. The rods 20 are optionally secured to a panel structure 26, also described as a wall structure, having a front 26*a* or other substantially vertical structure, such as an end cap of a shelving unit (not shown). Portions of the rods 20 around the cage 12 are not shown to allow the viewer to better see the cage 12. Although various embodiments are described in association with a retail environment, such as a store, other embodiments include use of the system 10 in any of a variety of environments, such as storage or home environments, for example.

FIG. 2 shows the merchandising system 10 with the merchandising cage 12 secured to another support assembly 14*b*. As shown in FIG. 2, the support assembly 14*b* includes a first member 28 and a second member 30, each of the members 28, 30 extending substantially vertically and including a plurality of spaced apart, substantially aligned, and regularly spaced slots 32 for releasably securing one or more substantially horizontal members 34 at a desired height off of (i.e., relative to) the floor 16. Similarly to the support assembly 14*a*, the first and second members 28, 30 are optionally secured to the wall structure 26 or other structure, such as an end cap.

Although some examples of support assembly configurations have been described, a variety of support assemblies, alternatively described as vertical standards or vertical supports, are contemplated.

Figure 3:
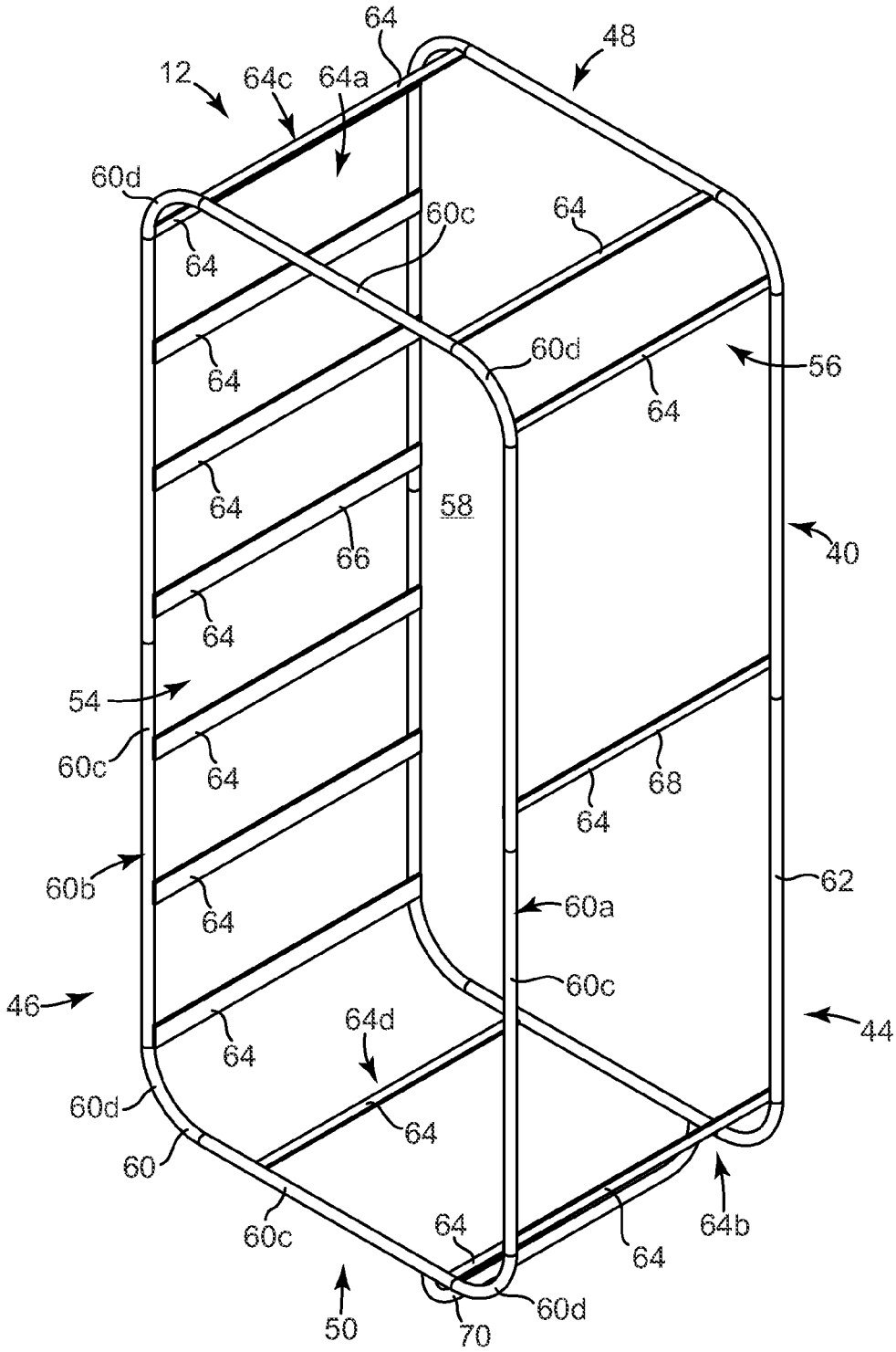
FIG. 3 shows a frame of a merchandising cage, according to some embodiments of the invention.
Figure 4:
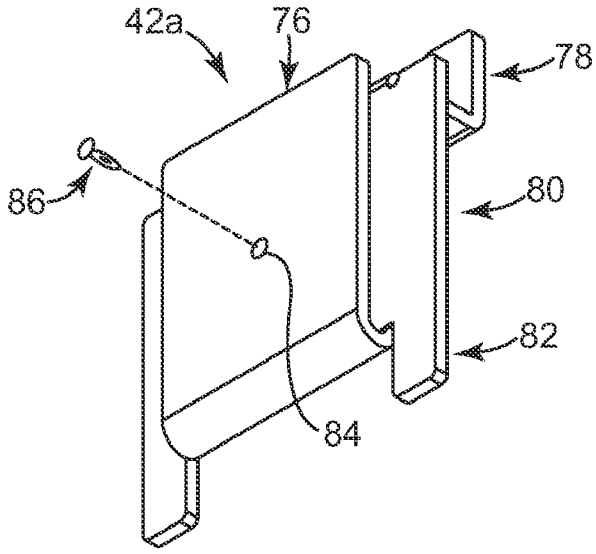
FIG. 4 is an isometric view of a support bracket of a merchandising cage, according to some embodiments of the invention.
Figure 5:
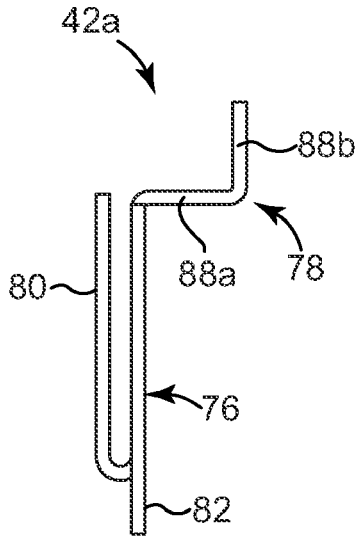
FIG. 5 is a side view of the support bracket of FIG. 4, according to some embodiments of the invention.
Figure 6:
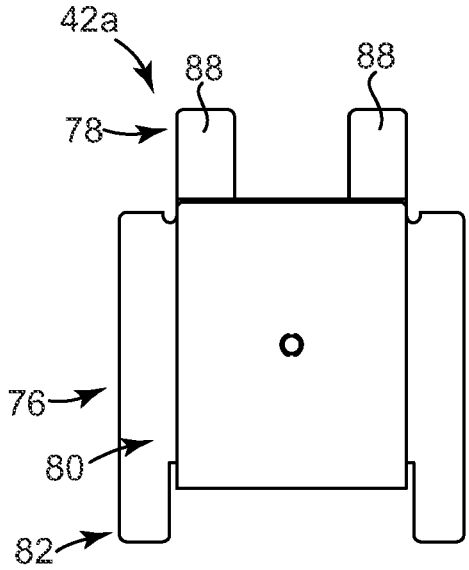
FIG. 6 is a front view of the support bracket of FIG. 4, according to some embodiments of the invention.

FIG. 3 is an isometric view of the merchandising cage 12, also described as an annular cage, a semi-ovular framework, or simply a "cage," according to some embodiments. The cage 12 includes a frame 40 and support brackets 42 (FIGS. 4-6). The frame 40 of the cage 12 has a front 44, a back 46, a top 48, a bottom 50, a first open side 54, a second open side 56, and an open interior 58 extending between the first and second open sides 54, 56. The frame 40 includes a first end piece 60 and a second end piece 62. Each of the first and second end pieces 60, 62 forms a substantially continuous ring or loop and is positioned in a substantially vertical orientation. The first and second end pieces 60, 62 are laterally spaced, each being set apart and are generally vertically aligned, being positioned adjacent one another at about the same height. The frame 40 also includes a plurality of cross bars 64 extending substantially horizontally between the first and second end pieces 60, 62. When viewed in side profile, the frame is generally annular and semi-ovular in shape, or semi-oval-shaped.

The first and second end pieces 60, 62 are formed with substantially similar dimensions, as well as substantially similar materials as desired. In some embodiments, the first and second end pieces 60, 62 are formed of metal tubing. As shown best in FIGS. 3 and 11, the end pieces 60, 62 each form a substantially continuous ring or loop that is reminiscent of an oval shape, such that the ring can be characterized as semi-ovular, having an elongate or long dimension (a major axis) and a shorter dimension (a minor axis) with four clearly rounded corners. With reference to the first end piece 60, each of the pieces 60, 62 includes a front 60*a* facing away from the wall 26 (FIG. 1) and a back 60*b* facing toward the wall 26, with four substantially flat sides 60*c* interconnected at rounded corners 60*d*. The end pieces 60, 62 can be formed using a variety of techniques, but in some embodiments are formed by bending metal tubing and welding the ends of the metal tubing together.

The plurality of cross bars 64 include a back set 64*a* extending across the back 52 of the frame 40, a front set 64*b* extending across the front 44 of the frame 40, a top set 64*c* extending across the top of the frame, and a bottom set 64*d* extending across the bottom 50 of the frame 40. Each of the cross bars 64 is optionally formed as substantially elongate, flat member and can be made of metal, plastic, or other suitable material. In some embodiments, the back set 64*a* includes a first cross bar 66 while the front set 64*b* includes a second cross bar 68, where the first and second cross bars 66, 68 are positioned toward the middle of the frame 40.

In some embodiments, the sets 64*a*, 64*b*, 64*c*, 64*d* of cross bars 64 act as tie members that secure the end pieces 60, 62 together to form the frame 40. For example, the cross bars 64 are optionally welded to the end pieces 60, 62. As shown, the frame 40 also includes a lower hang bar 70 fixed, for example by welding, to the bottom 50 of the frame 40, although lower hang bars that are adapted to be removable are also contemplated. Various items can be hung from the lower hang bar 70 including, for example, hangers supporting clothing or other merchandise such as that shown in FIG. 11. In some embodiments, at least some of the cross bars 64 are adapted to receive brackets, clips, or other securing means as described in greater detail below.

As shown in FIG. 1, the support brackets 42 are also described as hanging brackets or stirrups. The support brackets 42 include a first bracket 42*a* and a second bracket 42*b*. The first and second brackets 42*a*, 42*b* are optionally substantially similar and as such are described with reference to a first support bracket 42*a*, although differing configurations are contemplated.

The support bracket 42*a* is shown in greater detail in FIGS. 4-6. In some embodiments, the support bracket 42*a* includes a body 76 adapted to be received over at least one of the back set 64*a* of cross bars 64 (FIG. 3). The support bracket 42*a* also includes a hook portion 78 adapted to releasably secure the frame 40 to a support assembly, for example the support assemblies 14*a*, 14*b*, such that the frame 40 is maintained off of the floor 16 and projects outwardly from the front of the wall structure 26 (FIG. 1). In some embodiments, the support bracket 42*a* is formed as a single, monolithic unit, for example by one or more metal forming processes, such as bending and punching processes.

As shown in FIGS. 4-6, the body 76 of the support bracket 42*a* includes a substantially U-shaped portion 80 and a pair of ears 82 extending downwardly relative to the U-shaped portion 80. The U-shaped portion 80 includes a central hole 84 for receiving a fastener 86, such as a plastic clip, a bolt, or other fastener. The U-shaped portion 80 is adapted to receive one of the back set 64*a* of cross bars 64 (FIG. 3). The pair of ears 82 are adapted to rest against the support assembly 14*a*, and in particular the rods 20 (FIG. 1), as described in greater detail below.

In some embodiments, and as shown in FIGS. 4-6, the hook portion 78 includes a pair of recurved legs 88 for insertion into one of the slots 32 of the support assembly 14*a*. In particular, the legs 88 bend rearward and then upward to define rearward bends 88*a*, or portions, and upward bends 88*b*, or portions. In particular, the legs 88 can be tilted backward, with the upward bends 88*b* inserted into one of the slots 32, and then tipped down such that the upward bends 88*b* reside behind one of the rods 20 and the rearward bends 88*a* extend between adjacent rods 20 (FIG. 1). In this manner, the legs 88 are releasably retained in one of the slots 32 to secure the support bracket 42*a* relative to the support assembly 14*a*. Although the support brackets 42 are optionally adapted for use with the support assembly 14*a*, in other embodiments, the hook portion 78 is formed to have an inverted U-shape (not shown) that is releasably secured over one of the horizontal members 34 of the support assembly 14*b* (FIG. 2), for example.

The central hole 84 and fastener 86 are adapted to help releasably secure the body 76 of the support bracket 42*a* to one of the back set 64*a* of cross bars 64. For example, the fastener 86 is inserted through the hole 84 to frictionally engage the cross bar 64 in some embodiments. In other embodiments, the fastener 86 is inserted into the central hole 84 such that it is secured over the top of the cross bar 64 to act as a barrier, abutting the top of that cross bar 64 to prevent its ejection from the body 76, although a variety of interactions are contemplated.

As subsequently described, the cage 12 also includes a variety of optional accessories, such as one or more hang bars 100 (FIG. 7); a hang bar saddle 102 (FIG. 8); a merchandising ring 104 (FIG. 9); a merchandising panel 106 (FIG. 10); a basket 108 (FIG. 11); or others. The accessories 102-108 are used alone with the frame 40 or in any combination as desired.

Figure 7:
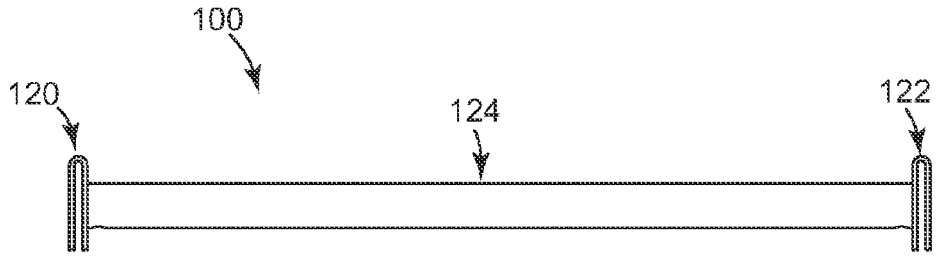
FIG. 7 is a side view of a hang bar for use with the merchandising systems of FIGS. 1 and 2, according to some embodiments of the invention.
Figure 10:
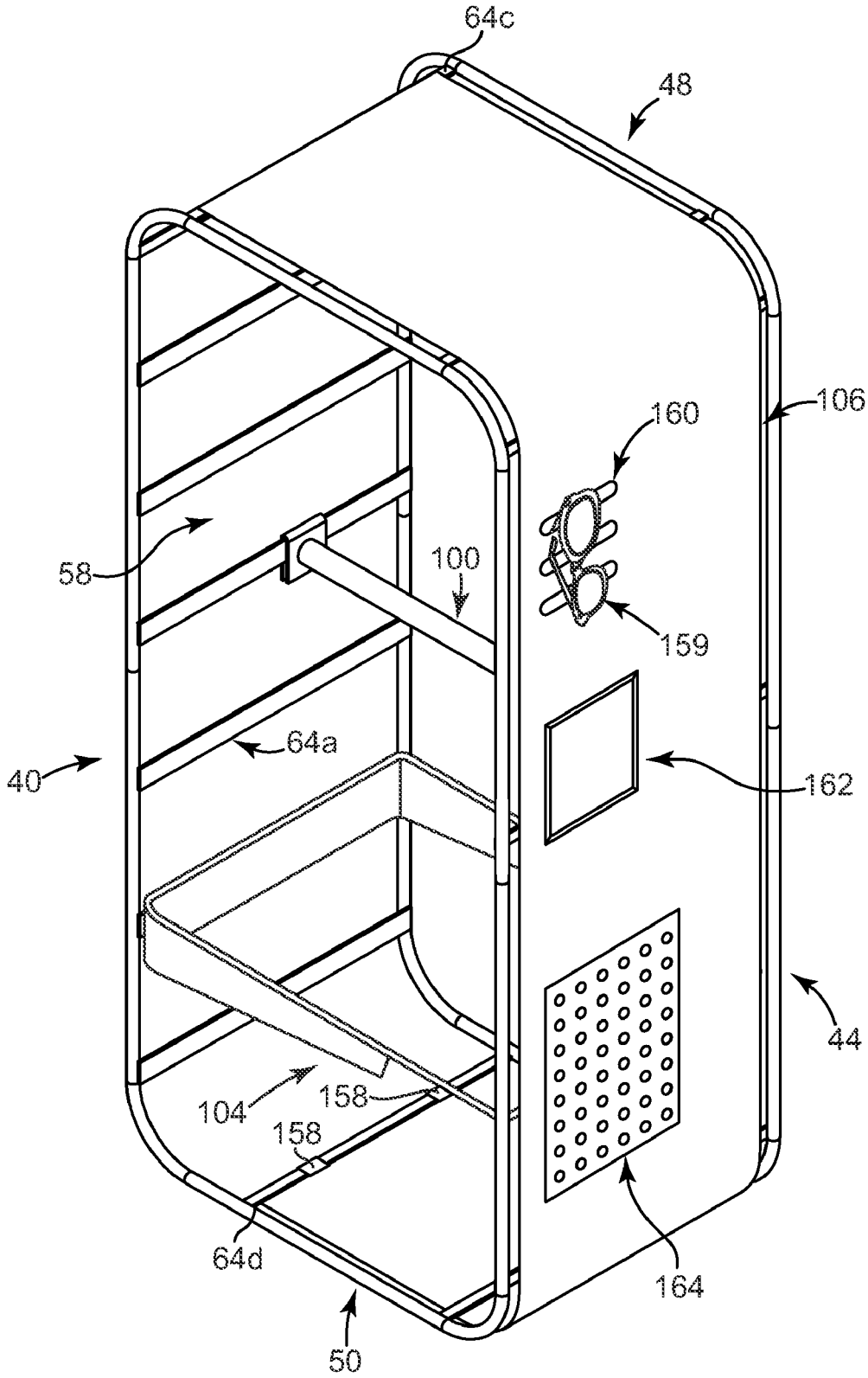
FIG. 10 is an isometric view of the merchandising cage with a merchandising panel, according to some embodiments of the invention.

As shown in FIG. 7, the hang bar 100, optionally described as an internal bar, is adapted to extend across the open interior 58 of the frame 40 as shown in FIG. 10 and to be releasably secured to the first and second cross bars 66, 68 (FIG. 3). In some embodiments, the hang bar 100 includes a first brace 120, or bracket, adapted to be releasably secured over the first cross bar 66, a second brace 122, or bracket, adapted to be releasably secured over the second cross bar 68, and a tubular body 124, or intermediate member, extending between the first and second braces 120, 122.

Figures 11, 11A, 12:
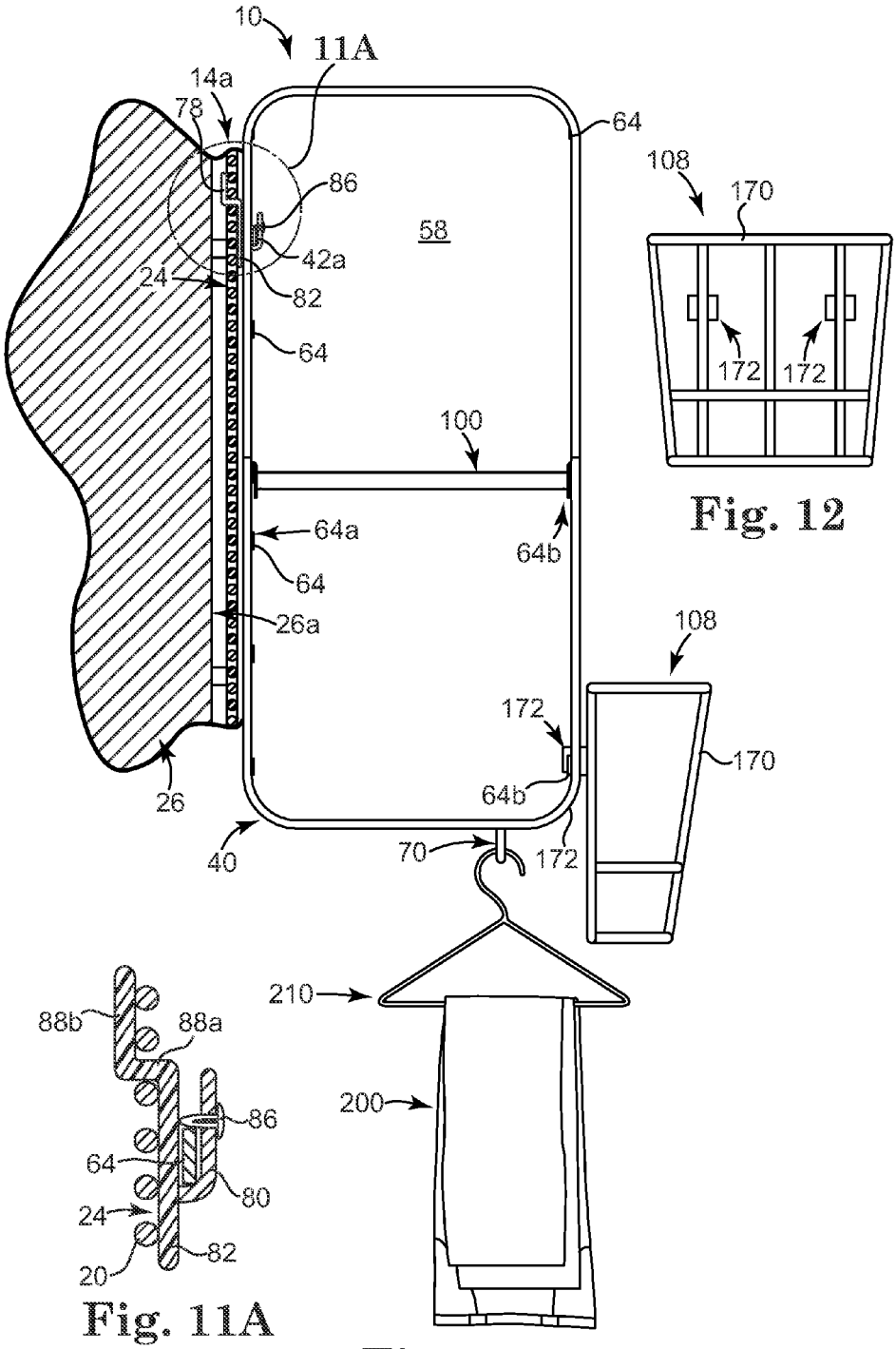
FIG. 11 is a side view of the merchandising cage of the merchandising system of FIG. 1 showing a basket accessory, according to some embodiments of the invention.
FIG. 11A is an enlarged view of a portion of FIG. 11, according to some embodiments.
FIG. 12 is a front view of the basket accessory of FIG. 11, according to some embodiments of the invention.

The tubular body 124 is adapted to support a variety of items, including other accessories, but according to some embodiments is suited for supporting clothing on hangers, such as the clothing item and hanger shown in FIG. 11, with the tubular body 124 acting as a clothing rod. In some embodiments, the first and second braces 120, 122 each have an inverted U-shape, are substantially square and flat when viewed from the front and back, and are adapted to be slid over the first and second cross bars 66, 68, respectively.

Figure 8:
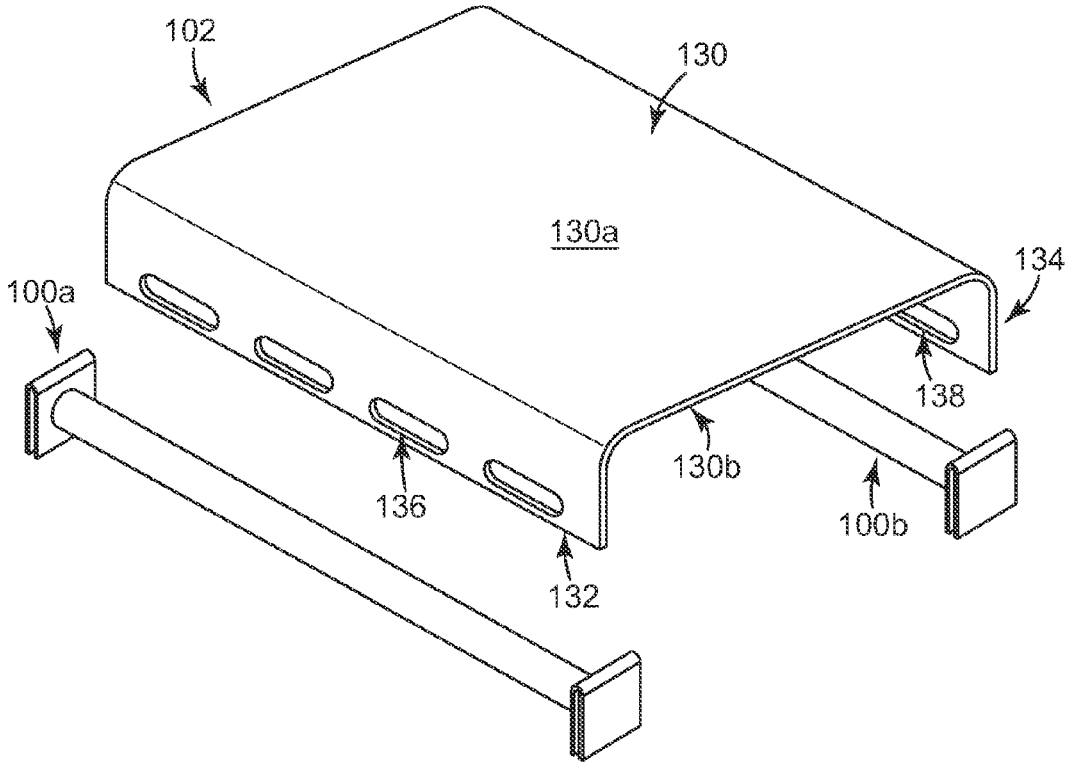
FIG. 8 is an isometric, exploded view of a pair of hang bars and a hang bar saddle, according to some embodiments of the invention.

As shown in FIG. 8, the hang bar accessory saddle 102 is adapted to fit over a pair of hang bars 100*a*, 100*b* secured within the open interior 58, which are each optionally substantially similar to the hang bar 100. The saddle 102 has a substantially flat top portion 130 defining a top face 130*a* and bottom face 130*b*. The saddle 102 also includes first and second side portions 132, 134 that extend downwardly from the top portion 130. The top face 130*a* of the top portion 130 can be used to support boxes (such as the box shown in FIG. 9) or other merchandise in some embodiments, for example stack of folded clothing items. The first and second side portions 132, 134 each include a plurality of elongate slots 136, 138, respectively, oriented lengthwise along each of the side portions 132, 134. The pluralities of elongated slots 136, 138 are adapted to receive hangers and/or hangable merchandise as desired.

In some embodiments, the hang bar accessory saddle 102 is received over the hang bars 100*a*, 100*b* with the bottom face 130*b* of the top portion 130 resting against the hang bars 100*a*, 100*b* and the side portions 132, 134 extending downwardly past the hang bars 100*a*, 100*b* such that the pluralities of slots 136, 138 are not covered by the hang bars 100*a*, 100*b*. If desired, a plurality of items hanging on hangers (such as the clothing item received on the hanger shown in FIG. 11) are hung from the hang bar accessory saddle 102, and thus the frame 40, using the slots 136, 138. The slots 136, 138 in particular, and the saddle 102 in general, can serve a variety of other functions as well, including the top portion 130 acting as a shelf for a box or folded clothing merchandise as previously referenced.

Figure 9:
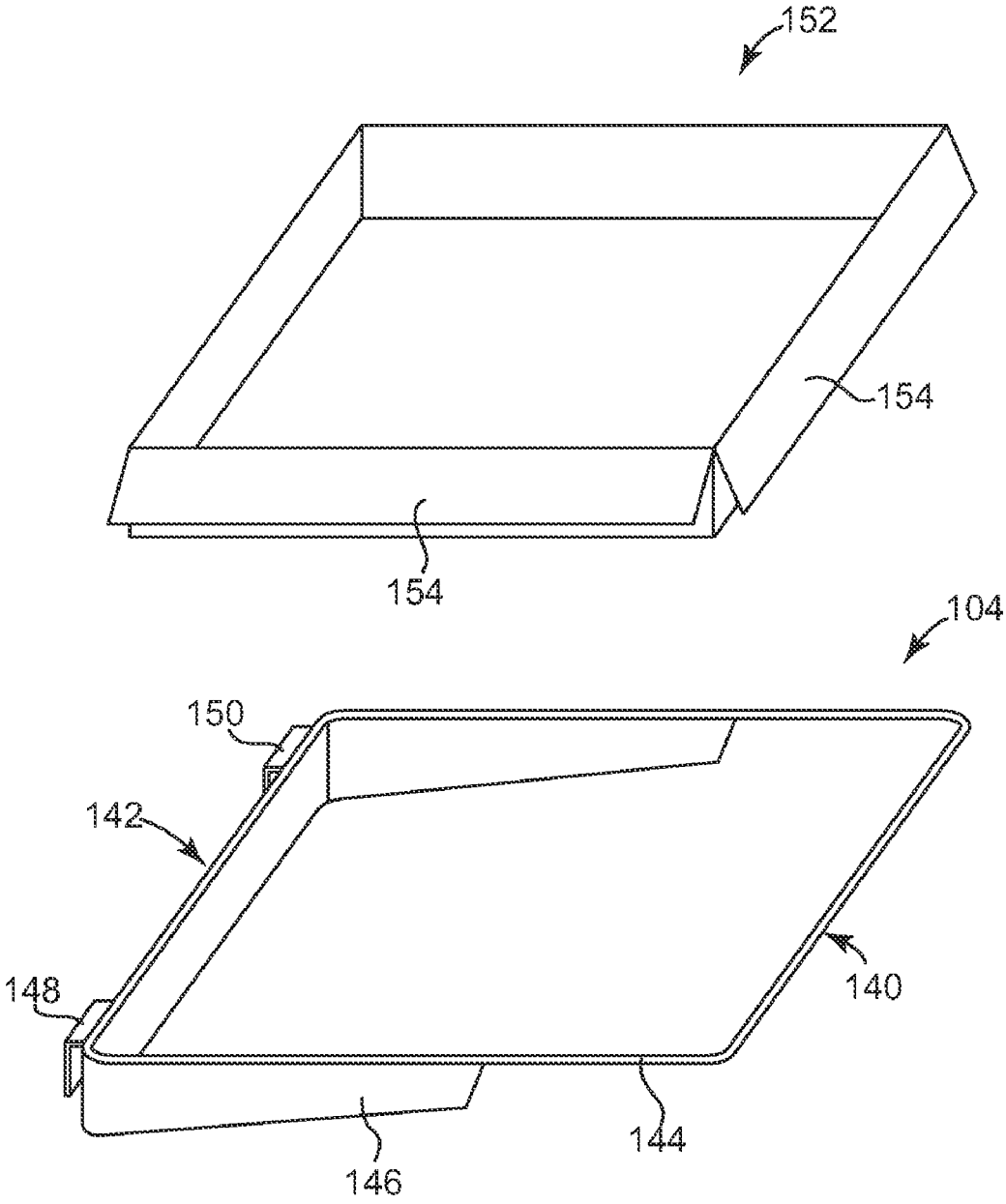
FIG. 9 is an isometric, exploded view of a merchandising ring and associated box, according to some embodiments of the invention.

As shown in FIG. 9, the merchandising ring 104 defines a front edge 140 and a back edge 142 and is adapted to be releasably secured to one of the back set 64*a* of cross bars 64 (FIG. 3). The merchandising ring 104 includes an upper ring portion 144, also described as an annular body, a reinforcing collar 146 secured to, and extending downwardly from, a portion of the upper ring portion 144, and a pair of brackets 148, 150 secured to the back edge 142 of the merchandising ring 104 which are adapted to be releasably secured over one of the cross bars 64, including one of the back set 64*a* of cross bars 64.

The brackets 148, 150 are optionally welded to the upper ring portion 144 and define a substantially inverted U-shape according to some embodiments, which allows the brackets 148, 150 be releasably secured over one of the cross bars 64. In some embodiments, the brackets 148, 150 are secured over the particular cross bar 64 such that the upper ring portion 144 extends substantially orthogonally from the back 46 of the frame 40 into the open interior 58 with the front edge 140 left hanging as a free edge within the open interior 58. In alternate terms, the merchandising ring 104 is substantially cantilevered to the frame 40 using the brackets 148, 150. The merchandising ring 104 is optionally made of metal or plastic materials, for example the upper ring portion 144 is optionally made of solid metal tubing and the reinforcing collar 146 is optionally made of sheet metal.

The reinforcing collar 146 extends about the back of the merchandising ring 144 and partially about the sides. The reinforcing collar 146 tapers downwardly in thickness at the sides and serves to reinforce the upper ring portion 144 against bending when it is under load. In particular, the reinforcing collar lends additional strength to the cantilevered configuration previous described. For example, as shown in FIG. 9, a box 152, for example a cardboard box, supporting various types of merchandise is optionally supported by the upper ring portion 144.

For example, the box 152 optionally includes a plurality of outwardly and downwardly folded flaps 154 that are received over the upper ring portion 144 to support the box 152 within the open interior 58 of the frame 40. If desired, the box 152 can be used to ship or store merchandise items and then be opened with the flaps 154 folded outwardly and downwardly such that the flaps 154 can be received over the upper ring portion 144 with the remainder of the box 152 received through the upper ring portion 144. In this manner, the box 152 serves both a shipping/storage function, as well as a display/merchandising function in combination with the merchandising ring 104.

As shown in FIG. 10, the merchandising panel 106 optionally provides one or more of a variety of retailing functions. In general terms, the merchandising panel 106 is secured over at least one of the front 44, the top 48, and the bottom 50 of the frame 40. The panel 106 is optionally configured as a thin wrap made of sheet plastic or paper, for example, to cover portions of the front 44, top 48, and/or bottom 50 with indicia such as merchandising information or enticing graphics, although the merchandising panel 106 can include any of a variety of indicia. The merchandising panel 106 is optionally clipped to one of the top set 64*c* of cross bars 64 and one of the bottom set 64*d* of cross bars 64 using flexible clips 158 or other fastening means, such as snaps or hook and loop fasteners, including those sold under the tradename "VELCRO".

In some embodiments, the merchandising panel 106 is substantial enough, i.e., structurally sound enough, to support various types of merchandise, such as a plurality of sunglasses 159. For example, the merchandising panel 106 optionally includes openings 160 or other features for receiving hangers or hangable merchandise (e.g., sunglasses as previously mentioned), one or more metal sections 162 for use with magnetic clips or hangers (not shown), and/or one or more pegboard sections 164 for use with hangers or hangable merchandise suited for use with pegboard (not shown).

As shown in FIGS. 11 and 12, the basket 108 includes a wire frame body 170 and one or more brackets 172 adapted to be secured one of the front set 64*b* of cross bars 64. The wire frame body 170 of the basket 108 is sized and shaped as desired to receive various types of merchandising items. In one embodiment, the basket 108 is sized and shaped to receive a plurality of picture albums, records for listening to on a record player, an assortment of loose items, or other merchandise as desired. The basket 108 has a substantially square profile when viewed from the front (FIG. 12) and a tapered, trapezoidal profile when viewed from the side as shown in FIG. 11.

Methods of assembling the merchandising system 10 and displaying merchandise to a consumer according to some embodiments include releasably securing the support brackets 42 to a support assembly, such as one of the support assemblies 14*a* (FIG. 1) and 14*b* (FIG. 2). FIG. 11A is an enlarged view showing the support bracket 42*a* following assembly. As understood in greater detail with reference to FIGS. 11 and 11A, the first bracket 42*a* is releasably received into one of the slots 24 of the support assembly 14*a* by inserting the hook portion 78, and in particular the ears 82 into the slot 24 and then tilting the body 76 downwardly against the adjacent rods 20 such that the first bracket 42*a* is retained in the particular slot 24. The second bracket 42*b* (FIG. 1) is similarly secured in the slot 24. One of the back set 64*a* of cross bars 64 is then slid downwardly into the U-shaped portions of the first bracket 42*a* and the second bracket 42*b* to maintain the frame 40 at a desired height off the floor 16 (FIG. 1). As shown, the merchandise cage 12 projects outwardly from the front face 26*a* of the wall 26 and is supported at a vertical distance off of the floor 16, for example at a height that is readily accessible by consumers in a retail environment.

The hang bar 100 is then optionally slid onto opposing cross bars 64 of the back and front sets 64*a*, 64*b*, for example the first and second cross bars 66, 68 (FIG. 3). A plurality of items, for example a clothing item 200 on a hanger 210 as shown in FIG. 11, is then hung from the hang bar 100.

Additionally or alternatively, the first and second hang bars 100*a*, 100*b* (FIG. 8) are secured onto opposing cross bars 64 of the back and front sets 64*a*, 64*b* and the hang bar saddle accessory 102 (FIG. 8) is slid onto the first and second cross bars 66, 68 as previously described. If desired, a plurality of items, such as clothing on hangers for example, similar to clothing 200 and hanger 210, shown in FIG. 11), are hung from the slots 136, 138 in the saddle 102.

Additionally or alternatively, as shown in FIG. 10 the merchandising ring 104 is secured over one of the cross bars 64, for example one of the back set 64*a*. More specifically, the brackets 148, 150 (FIG. 9) are slidably received over the particular cross bar 64. A plurality of retail items is placed in the box 152 (FIG. 9) or the retail items are previously disposed in the box 152, for example during shipping. The box 152 is opened with the flaps 154 folded outwardly and downwardly and received over the upper ring portion 144 such that the box is supported by the merchandising ring 104 in the open interior 58 of the frame 40, with the merchandising ring 104 extending inwardly from one of the cross bars 64 in a cantilevered fashion. In some embodiments, the merchandising ring 104 and box 152 are provided together as a kit of parts.

Additionally or alternatively, as shown in FIG. 10, the merchandising panel 106 is secured over portions of one or more of the top 48, front 44, and bottom 50 of the frame 40. In some embodiments, the merchandising panel 106 is wrapped about the top 48, front 44, and bottom 50 of the frame 40, respectively to substantially cover them while leaving the sides of the frame 40 open. The merchandising panel 106 is clipped to one of the top set 64*c* of cross bars 64 and one of the bottom set 64*d* of cross bars 64 using flexible clips 158 to secure the merchandising panel 106 in position.

The merchandising panel 106 can include indicia, such as words, graphics, or others which are thereby displayed to a consumer for retailing purposes, for example. As previously referenced, the merchandising panel 106 additionally or alternatively includes openings 160 or other features for receiving hangers or hangable merchandise (e.g., sunglasses), one or more metal sections 162 for use with magnetic clips or hangers (not shown), and/or one or more pegboard sections 164 for use with hangers or other hanger means suited for use with pegboard (not shown). Thus, in some embodiments, a plurality of retail items are also hung from the merchandising panel 106 for display/shelving purposes.

As shown in FIG. 11, the basket 108 is optionally secured to one of the cross bars 64, for example onto one of the front set 64*b* of cross bars 64. Merchandise or other items (not shown) are then placed in the basket 108 as desired. Furthermore, the plurality of clothing items on hangers such as clothing item 200 and hanger 210, or other hanger means, are hung from the lower hang bar 70 as shown in FIG. 11.

In view of the foregoing, the merchandising system provides means for providing a semi-ovular framework for displaying a plurality of retail items, including, for example the frame 40; means for adjustably and releasably securing the semi-ovular framework to a substantially vertical wall structure, including, for example the support brackets 42; means for hanging or otherwise supporting a plurality of retail items within the ovular framework and from the semi-ovular framework for display to a consumer, including, for example one or more of the hang bars 100, the merchandising ring 104 and box 152, or the saddle accessory 102; and means for selectively covering a front of the semi-ovular framework with indicia associated with the plurality of retail items, including for example, the merchandising panel 106.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A merchandising cage hanging from a substantially vertical standard on a floor in a retail environment, the merchandising cage comprising:

a frame having a front, a back, a first open side, a second open side, and an open interior between the first and second open sides, the frame including:

a first end piece forming a substantially continuous ring and positioned in a substantially vertical orientation;

a second end piece forming a substantially continuous ring and positioned in a substantially vertical orientation, the second end piece spaced laterally adjacent the first end piece;

a plurality of cross bars extending substantially horizontally between the first and second end pieces, the plurality including a first cross bar extending across the back of the frame and a second cross bar extending across the front of the frame; and a one-piece hanging bracket including a hook portion inserted into the substantially vertical standard to releasably secure the frame to the substantially vertical standard and off of the floor, a body extending along and supported against the substantially vertical standard, and an upwardly-oriented U-shaped portion, one side of which being formed by the body and the other side being separated from the body and bent into the U-shape, un-separated portions of the body defining a pair of ears extending downwardly relative to the U-shaped portion in planar alignment with the body and on opposite sides of the U-shaped portion, wherein the first cross bar slides into and is held in the U-shaped portion.

2. The merchandising cage of claim 1, wherein the hook portion includes a pair of recurved legs for insertion into a slot of the substantially vertical standard.

3. The merchandising cage of claim 1, wherein the frame is formed of tubing.

4. The merchandising cage of claim 1, further comprising a hang bar extending across the open interior of the frame and releasably secured to the first and second cross bars, the hang bar including a first brace releasably secured over the first cross bar, a second brace releasably secured over the second cross bar, and a tubular body extending between the first and second braces, the tubular body adapted to receive a plurality of clothing hangers.

5. The merchandising cage of claim 4, wherein the first and second braces each have a substantially inverted U-shape.

6. The merchandising cage of claim 5, wherein the first and second cross members are substantially flat, metal bars.

7. A merchandising system for displaying products in a retail environment, the system comprising:

a panel structure extending upwardly from a floor, the panel structure having a front and forming a plurality of regularly spaced insertion areas;

an annular cage supported over the floor by the panel structure and projecting outwardly from the front, the annular cage including:

a first loop defining a front and a back with the back facing toward the panel structure and the front facing away from the panel structure, the first loop having four substantially flat sides interconnected at rounded corners such that the first loop has a semi-oval shape;

a second loop defining a front and a back and being oriented parallel to the first loop and positioned laterally adjacent the first loop, the second loop having four substantially flat sides interconnected at rounded corners such that the first loop has a semi-oval shape;

at least two front tie members spaced vertically adjacent from one another and extending laterally between the fronts of the first and second loops;

at least two back tie members spaced vertically adjacent from one another and extending laterally between the backs of the first and second loops;

a first one-piece stirrup releasably secured to a first one of the insertion areas of the panel structure, the first stirrup including a first body extending along and supported against the panel structure and a first upwardly-oriented U-shaped portion, one side of which being formed by the first body and the other side being separated from the first body and bent into the U-shape, un-separated portions of the first body defining a first pair of ears extending downwardly relative to the first U-shaped portion in planar alignment with the first body, wherein one of the back tie members slides into and is held in the first U-shaped portion; and a second one-piece stirrup spaced laterally from the first stirrup and releasably secured to one of the insertion areas of the panel structure at a laterally spaced position from the first stirrup, the second stirrup including a second body extending along and supported against the panel structure and a second upwardly-oriented U-shaped portion, one side of which being formed by the second body and the other side being separated from the second body and bent into the U-shape, un-separated portions of the second body defining a second pair of ears extending downwardly relative to the second U-shaped portion in planar alignment with the second body, wherein one of the back tie members slides into and is held in the second U-shaped portion.

8. The system of claim 7, wherein the panel structure includes a plurality of regularly spaced apart, substantially horizontal bars and the first and second stirrups are inserted into spaces between the bars.

9. The system of claim 7, further comprising a plurality of clothing items supported by the annular cage.

10. The system of claim 7, wherein the first and second loops are formed of a substantially continuous ring of tubing.

11. The system of claim 7, wherein the panel structure includes a first plurality of slots and a second plurality of slots laterally adjacent to the first plurality of slots.

12. The system of claim 7, further comprising:

an internal bar extending substantially parallel to the first and second loops, the internal bar including a first inverted U-shaped bracket and a second inverted U-shaped bracket, the first and second brackets secured to one of the front and back tie members, respectively, and an intermediate member extending between the first and second U-shaped brackets; and a plurality of hangers supporting clothing items, the plurality of hangers hanging from the intermediate member.

13. The system of claim 7, further comprising a wrap of sheet material covering a substantial portion of the annular cage, the sheet material including indicia.

14. The system of claim 7, further comprising a merchandising ring, the merchandising ring including:

a substantially annular body oriented in a substantially horizontal position, the substantially annular body having a front and a back; and an inverted U-shaped bracket secured to the back of the substantially annular body and releasably secured over one of the back tie members.

15. The system of claim 7, wherein the front and back tie members are substantially flat metal bars welded to the first and second loops.

* * * * *